US005590543A

United States Patent [19]

Agrawal et al.

[11] Patent Number: 5,590,543

[45] Date of Patent: Jan. 7, 1997

[54] PRODUCTION OF ULTRA-HIGH PURITY OXYGEN FROM CRYOGENIC AIR SEPARATION PLANTS

[75] Inventors: Rakesh Agrawal, Emmaus; Donn M. Herron, Fogelsville; Thomas R. White, Allentown, all of Pa.

[73] Assignee: Air Products and Chemicals, Inc., Allentown, Pa.

[21] Appl. No.: 520,451

[22] Filed: Aug. 29, 1995

[51] Int. Cl.[6] ..... F25J 3/04

[52] U.S. Cl. ..... 62/643; 62/905

[58] Field of Search ..... 62/643, 905

[56] References Cited

U.S. PATENT DOCUMENTS 3,363,427 1/1968 Blanchard et al. .
4,560,397 12/1985 Cheung .
4,615,716 10/1986 Cormier et al. ..... 62/643
4,755,202 7/1988 Cheung .
4,869,741 9/1989 McGuinness et al. .
5,049,173 9/1991 Cormier, Sr. et al. .
5,218,825 6/1993 Agrawal ..... 62/651
5,231,837 8/1993 Ha ..... 62/646
5,282,365 2/1994 Victor et al. ..... 62/905 X
5,425,241 6/1995 Agrawal et al. ..... 62/643

*Primary Examiner*—Christopher Kilner
*Attorney, Agent, or Firm*—Willard Jones, II

[57] ABSTRACT

The present invention relates to an improvement to cryogenic air separation processes which produce an ultra-high purity oxygen product and nitrogen and/or commercial purity oxygen products. In particular, the improvement of the present invention is characterized by removing a portion of liquid descending the distillation column system from the distillation section proximate to the location for withdrawing the oxygen-containing side-draw stream.

15 Claims, 5 Drawing Sheets

PRODUCTION OF ULTRA-HIGH PURITY OXYGEN FROM CRYOGENIC AIR SEPARATION PLANTS

TECHNICAL FIELD

The present invention is related to a process for the cryogenic distillation of air or oxygen/nitrogen mixtures to produce nitrogen and/or commercial purity oxygen and small quantities of ultra-high purity oxygen.

BACKGROUND OF THE INVENTION

Numerous processes are known in the art for the production of an ultra-high purity oxygen product stream by using cryogenic distillation; among these are the following:

U.S. Pat. No. 5,049,173 discloses an improvement to a process for the production of ultra-high purity oxygen from cryogenic air separation processes which produce nitrogen and/or commercial purity oxygen products. In particular, the improvement comprises removing or producing an oxygen-containing but heavy contaminants-lean (free) stream from one of the distillation columns of a single or multiple column cryogenic air separation facility and further stripping the removed or produced oxygen-containing stream in a fractionator to produce ultra-high purity oxygen (i.e., contaminants concentration<10 vppm).

U.S. Pat. No. 3,363,427 discloses a process for the production of ultra-high purity oxygen from a commercial grade oxygen stream, which typically has an oxygen concentration of about 99.5–99.8 vol %, a small amount of argon as a light impurity and small quantities of heavier impurities consisting of a variety of hydrocarbons (mainly methane), krypton and xenon. In the process, hydrocarbons are either removed by combustion in a catalytic chamber or as purge liquid from an auxiliary distillation column. When a catalytic combustion unit is not used, multiple distillation columns are used with various heat exchangers and reboiler/condensers to effectuate the separation. In this operating mode, refrigeration to the system is provided by either importing liquid nitrogen from an external source or using a nitrogen stream from the air separation unit that is recycled back to the air separation unit, thus transferring refrigeration from one point to another. This catalytic combustion option requires an additional compressor and heat exchangers. U.S. Pat. No. 4,560,397 discloses a process to produce ultra-high purity oxygen and a high pressure nitrogen by cryogenic distillation of air. In the process, the feed air is fractionated in a high pressure column producing a nitrogen product stream, which is removed from the top of the high pressure column, and a crude liquid oxygen stream, which is removed from the bottom of the high pressure column. This crude liquid oxygen stream is laden with all the heavy impurities contained in the feed air and also contains a majority of the argon contained in the feed air. A portion of this crude liquid oxygen stream is distilled in a secondary lower pressure column to produce a so called ultra-high purity oxygen. Since all the heavy impurities will travel with the oxygen downward in this secondary column, it is impossible to produce a liquid oxygen product with trace low concentrations of impurities directly from this column. To overcome this problem, a gaseous oxygen product is removed at a point at least one equilibrium stage above the reboiler/condenser of this secondary column. Since, however, this vapor stream is in equilibrium with a liquid stream with high concentrations of heavies it is impossible to reduce the concentration of heavy impurities to the desired levels. For example, referencing the results cited in this patent, the concentration of methane in the so called ultra-high purity oxygen is 8 vppm and of krypton is 1.3 vppm. By the ultra-high purity oxygen standards required specifically for electronic industry, these concentrations would be considered high; the typical hydrocarbon content of ultra-high purity oxygen for the electronic industry is less than 1 vppm.

U.S. Pat. No. 4,755,202 discloses a process to produce ultra-high purity oxygen from an air separation unit using double column cycle. In this process, an enriched oxygen-containing stream (oxygen concentration range from 90.0 to 99.9%) is withdrawn from the bottom of the lower pressure column and is fed to a counter-current absorption column. In the absorption column, the ascending enriched oxygen-containing stream is cleaned of heavier components by a descending liquid stream. A hydrocarbon-lean enriched oxygen-containing stream is removed from the top of the absorption column and is subsequently condensed. A portion of this condensed hydrocarbon-lean stream is recycled as reflux to the absorption column, while the other portion is sent to a stripping column. In the stripping column, the descending hydrocarbon-lean liquid stream is stripped of the light components, such as argon, to produce an ultra-high purity liquid oxygen product at the bottom. A portion of the ultra-high purity liquid oxygen is reboiled to provide a vapor stream for the stripping column. This vapor stream is removed from the top of the stripper column and is recovered as a secondary product. In essence, this process has two undesirable features. The first is that by using a feed oxygen stream from the bottom of the low pressure column which is contaminated with both light and heavy impurities, two distillation columns are required to perform the separation (an absorption column and a stripping column). The second is that the process generates an oxygen-containing vapor stream at the top of the stripping column which has an increased argon concentration; it is usually undesirable to have secondary oxygen product stream with decreased oxygen content.

U.S. Pat. No. 4,869,741 discloses a process to produce ultra-high purity oxygen. In the process, a liquid oxygen-containing heavy and light contaminants is used as the feed stream. In the process, two distillation columns, three reboiler/condensers and a compressor on the recirculating nitrogen stream along with a main heat exchanger are used to effectuate the separation.

SUMMARY OF THE INVENTION

The present invention relates to a process for the fractionation of air by cryogenic distillation using a cryogenic distillation column system comprising at least one distillation column, wherein a feed air stream is compressed, cooled to near its dew point and fed to the distillation column system for rectification thereby producing a nitrogen-containing overhead and a crude liquid oxygen bottoms; wherein an oxygen-containing side-draw stream essentially free of heavier contaminants comprising hydrocarbons, carbon dioxide, xenon and krypton is removed from the distillation column and stripped in an auxiliary stripping column to produce an ultra-high purity oxygen product at the bottom of the auxiliary stripping column; and wherein the oxygen-containing stream is removed from a location of the distillation column system primarily separating oxygen and nitrogen and has an oxygen concentration between 1% to 35% oxygen.

The improvement of the present invention is characterized in that a portion of liquid descending the distillation column system is removed from the distillation section of the distillation column system at or near, preferably at, (proximate to) the location for withdrawing the oxygen-containing side-draw stream for the auxiliary stripping column thereby reducing the liquid to vapor ratio in the distillation section between where the oxygen-containing side-draw stream is withdrawn and the top most heavies-containing feed is introduced. The removed liquid portion, referred to as the bypass, is used elsewhere within the process; preferably, the removed liquid portion is introduced to the distillation column system at a location proximate to where the topmost heavies-containing feed is introduced. The reduced vapor to liquid ratio significantly inhibits the oxygen-nitrogen separation, which, in turn, increases the oxygen content of the oxygen-containing side-draw stream, thereby increasing the oxygen production from the auxiliary stripping column.

In the present invention, the removed oxygen-containing side-draw stream to be stripped can be removed as either a liquid stream or vapor stream.

In the present invention, the heat duty to provide reboil to the auxiliary stripping column can be provided by either subcooling at least a portion of the crude liquid oxygen bottoms from the distillation column of the cryogenic distillation column system or by at least partially condensing a portion of the nitrogen overhead from the distillation column of the cryogenic distillation column system or by condensing or cooling any suitable process fluid.

The improvement of the present invention is applicable to cryogenic distillation column systems which comprises a high pressure distillation column and a low pressure distillation column, wherein the feed air stream is compressed, cooled to near its dew point and fed to the high distillation column system for rectification thereby producing a nitrogen-containing overhead and a crude liquid oxygen bottoms and wherein the crude liquid oxygen bottoms is reduced in pressure, fed to and further fractionated in the low pressure distillation column thereby producing a low pressure nitrogen overhead. The removed oxygen-containing side-draw stream can be removed from the low pressure column or the high pressure column.

The improvement of the present invention is also applicable to cryogenic distillation column systems consisting of a single (nitrogen generator) distillation column and wherein said auxiliary stripping column is refluxed with a liquid stream from the distillation column which is essentially free of heavier components comprising hydrocarbons, carbon dioxide, xenon and krypton.

DETAILED DESCRIPTION OF THE INVENTION

The present invention is an improvement to conventional air separation processes having distillation column system comprising a primary distillation column system and a auxiliary stripping column for the purpose of producing quantities of ultra-high purity oxygen wherein an oxygen-containing side-draw stream (either as a liquid or a vapor) is withdrawn from a location of the primary distillation column system where the removed stream is essentially free of components heavier than oxygen, such as hydrocarbons, carbon dioxide, xenon and krypton, and subsequently stripping that oxygen-containing side-draw stream in the auxiliary stripping column to produce a ultra-high purity oxygen product. The primary distillation column system may comprise one or more distillation columns. The improvement of the present invention is characterized in that a portion of liquid descending the distillation column system is removed from the distillation section of the distillation column system at or near, preferably at, the location for withdrawing the oxygen-containing side-draw stream for the auxiliary stripping column thereby reducing the liquid to vapor ratio in the distillation section between where the oxygen-containing side-draw stream is withdrawn and the top most heavies-containing feed is introduced. The removed liquid portion, referred to as the bypass, is used elsewhere within the process. The reduced vapor to liquid ratio significantly inhibits the oxygen-nitrogen separation, which, in turn, increases the oxygen content of the oxygen-containing side-draw stream, thereby increasing the oxygen production form the auxiliary stripping column.

Figure 1:
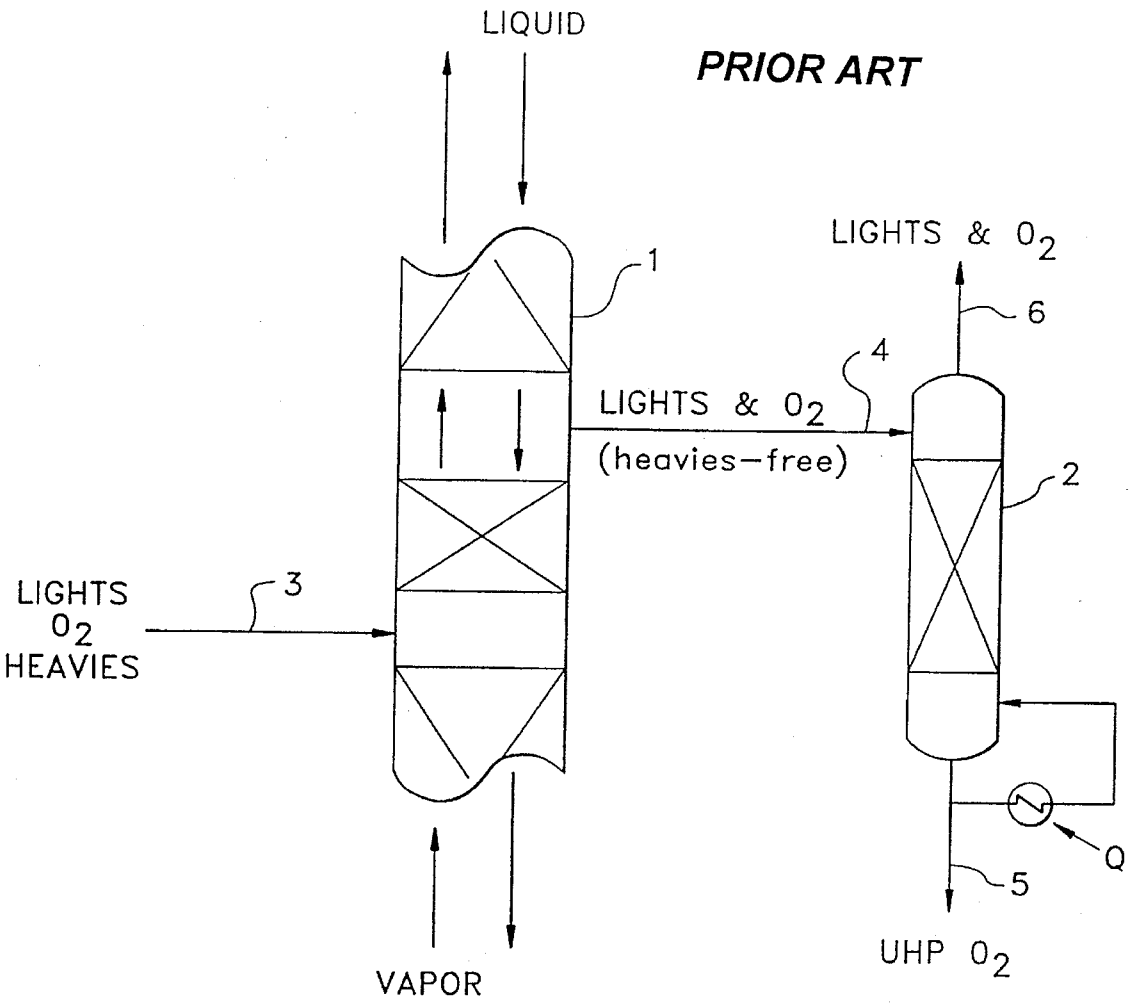
FIG. 1 is a schematic diagram detailing a key feature of U.S. Pat. No. 5,049,173.

To better understand the improvement to the present invention, attention is directed to FIG. 1, which illustrates the key feature of U.S. Pat. No. 5,049,173. In FIG. 1, liquid is descending and vapor is ascending primary distillation column 1, the composition of both changing in relation to the distillation occurring in the primary distillation column. An oxygen-containing side-draw stream (either liquid or vapor) which is essentially free of heavy components is removed from primary distillation column 1 via line 4 and fed to the top of auxiliary stripping column 2 to effectuate a separation into a ultra high purity oxygen product stream, in line 5, and a lights-contaminated overhead stream, in line 6.

Figure 2:
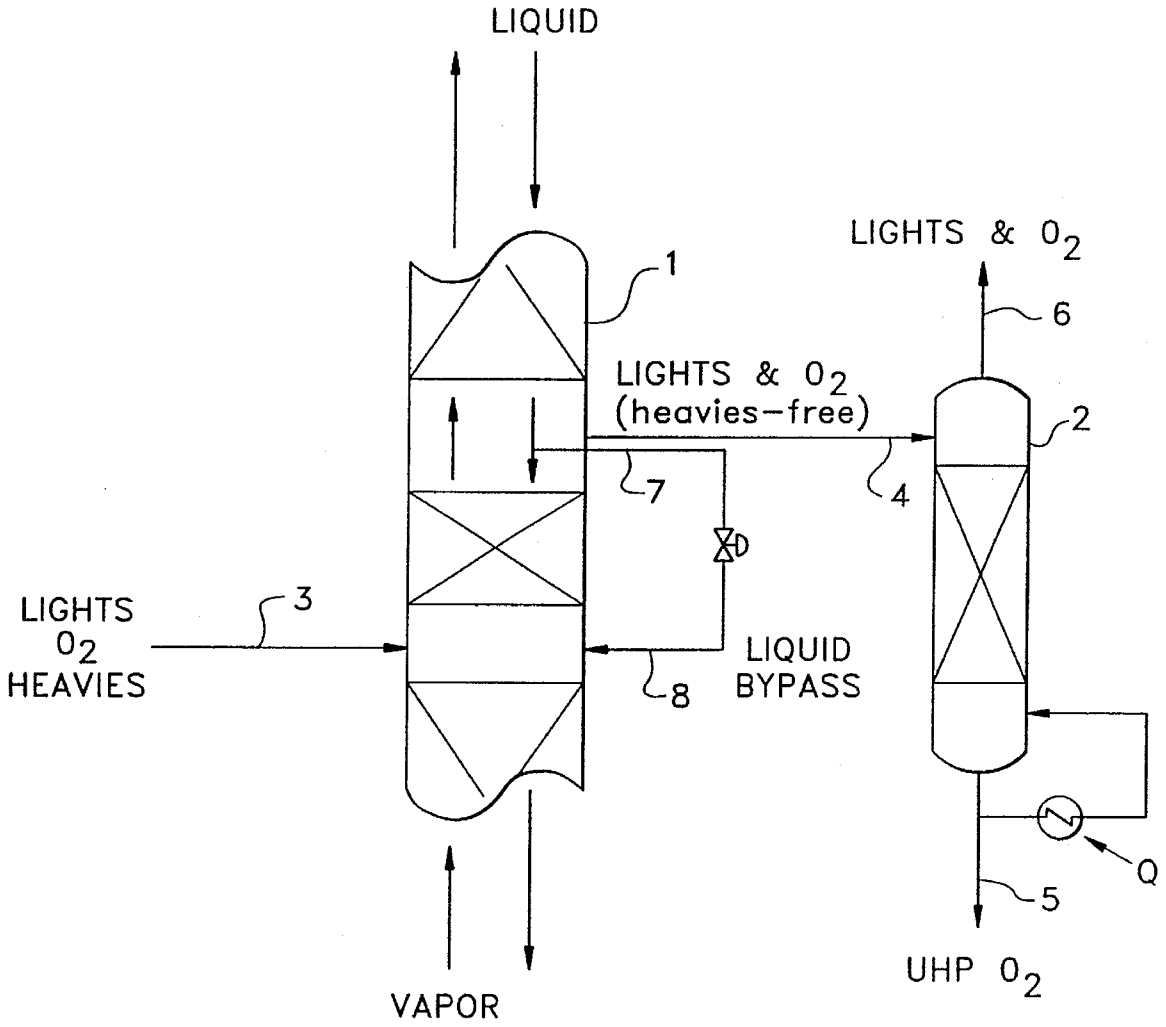
FIG. 2 is a schematic diagram detailing the improvement feature of the present invention.

Turning now to FIG. 2, which illustrates the improvement of the present invention. In FIG. 2, again, liquid is descending and vapor is ascending primary distillation column 1, the composition of both changing in relation to the distillation occurring in the primary distillation column. An oxygen-containing side-draw stream (either liquid or vapor) which is essentially free of heavy components is removed from primary distillation column 1 via line 4 and fed to the top of auxiliary stripping column 2 to effectuate a separation into a ultra high purity oxygen product stream, in line 5, and a lights-contaminated overhead stream, in line 6. However, a portion of the liquid descending the primary distillation column is removed via line 7 as a bypass at essentially the same location as the withdrawal point of the oxygen-containing side-draw stream via line 4. This removed liquid bypass stream is then introduced and mixed with a liquid in primary distillation column 1 via line 8 at essentially the same location as feed to primary distillation column 1. In the case wherein the oxygen-containing side-draw stream, line 4, is removed as a liquid, the bypass liquid, line 7, would be removed as a portion of oxygen-containing side-draw stream, line 4.

The improvement of the present invention is best understood as applied to a conventional process for producing an ultra-high purity oxygen product by removing from a location of any fractionation column which is separating nitrogen and oxygen, of an air separation unit a side-draw stream which contains some oxygen, yet is extremely lean in or devoid of heavy components, such as carbon dioxide, krypton, xenon and light hydrocarbons. The removed side-draw stream can be removed as either a vapor or liquid. Such a location is typically several stages above the air feed to the high pressure column of a single or double column system or several stages above the crude liquid oxygen feed to a low pressure column of a two or three column system. This removed heavy contaminant-free, oxygen-containing side-draw stream is subsequently separated by stripping in an auxiliary distillation column to produce an ultra-high purity oxygen product at the bottom of such column. By removing the portion of bypass liquid in line 7 and reintroducing it in line 8, the portion of removed liquid that would normally provide reflux to the distillation section of primary distillation column 1 between the feed in line 3 and the side stream in line 4 bypasses the subject section. In doing so, the LN ratio in the subject section is lower, thereby increasing the oxygen concentration of the oxygen-containing side-draw stream in line 4 while, still, assuring that the oxygen-containing side-draw stream is free of heavies.

Figure 3:
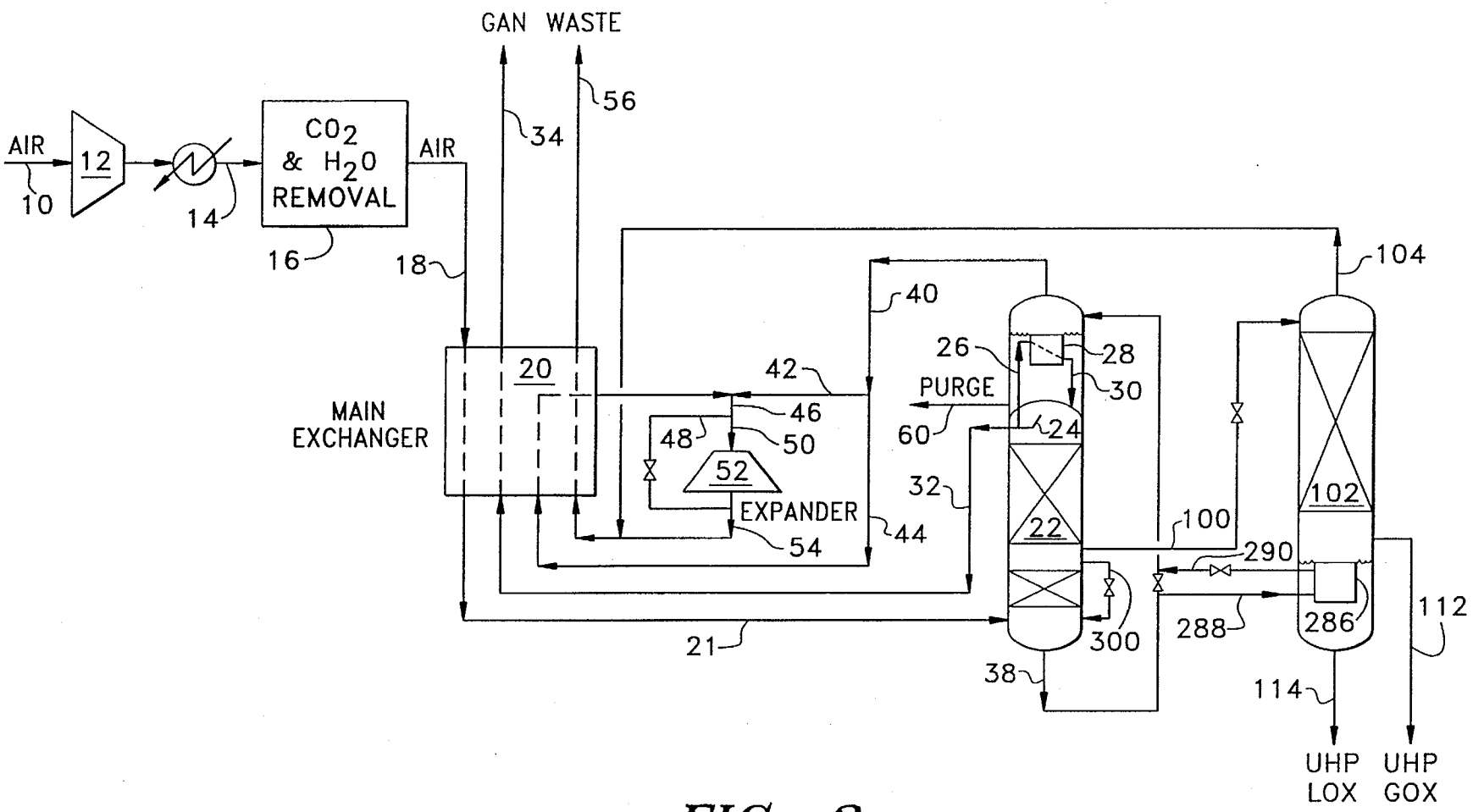
FIGS. 3–5 are schematic flowsheets showing alternative embodiments of the process of the present invention.
Figure 4:
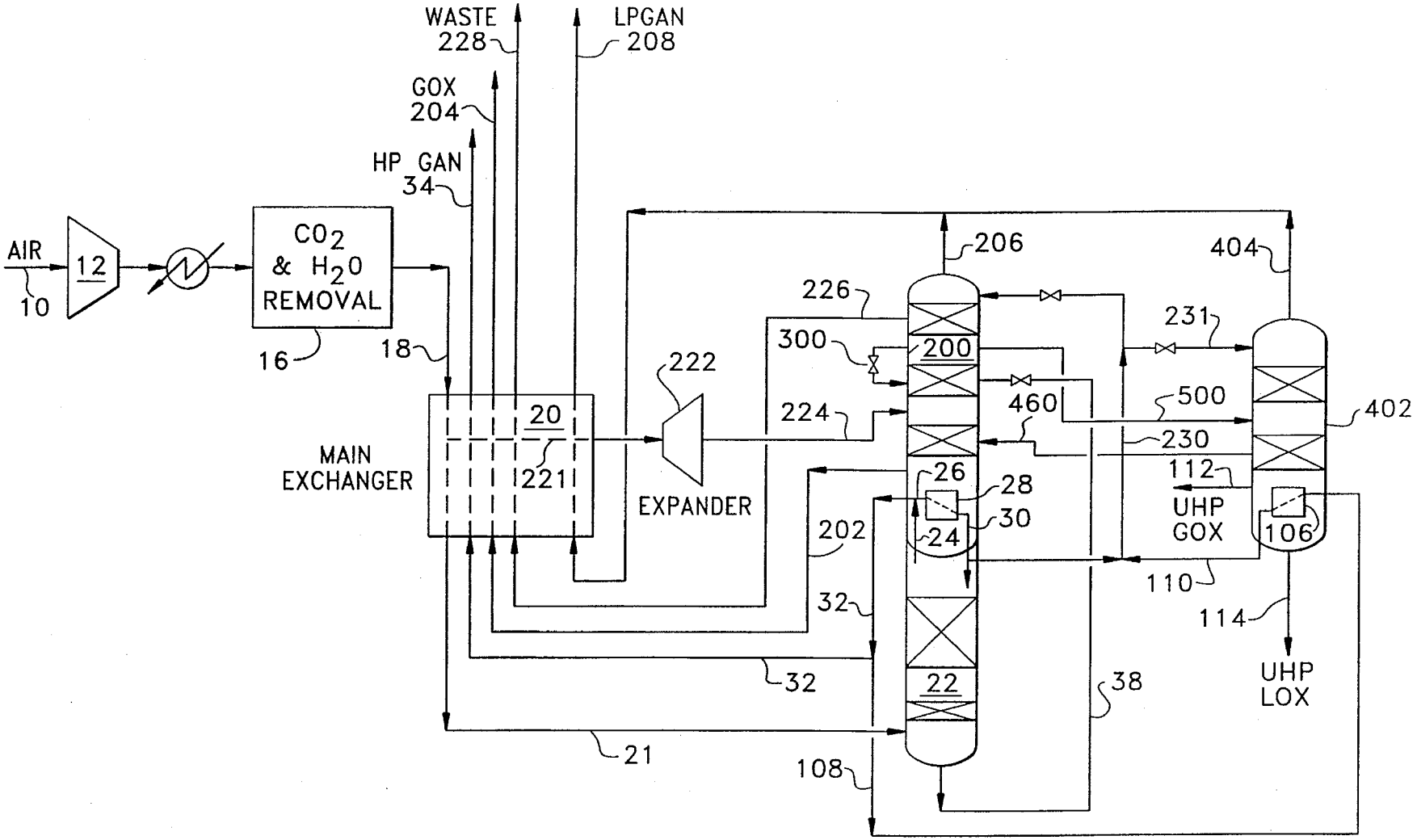
Figure 5:
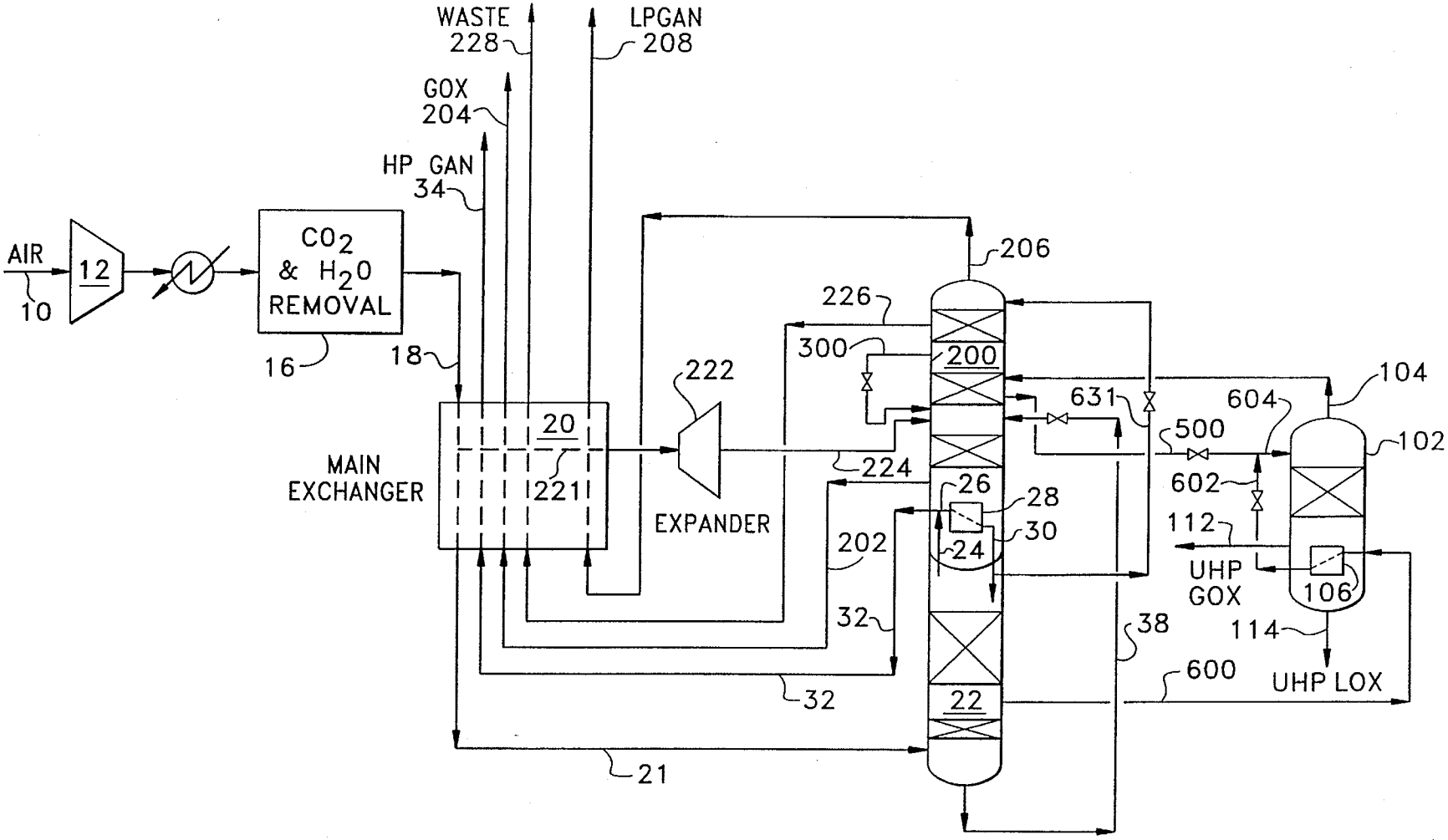

The improvement of the present invention can be best understood in light of the following discussion of three variations which are illustrated by the flowsheets in FIGS. 3–5. These flowsheets can be divided into two subcategories. The first subset draws an oxygen-containing but heavies-free liquid stream from the high pressure and/or the low pressure columns of a two column system and performs separation to recover ultra-high purity oxygen. The second subset draws an oxygen-containing but heavies-free vapor stream from the high pressure and/or the low pressure columns and performs a further separation on this stream to recover ultra-high purity oxygen. First the subset with liquid withdrawal will be discussed followed by a discussion of the vapor withdrawal subset. Common streams and equipment in FIGS. 3–5 are identified by the same number.

FIG. 3 shows a flowsheet based on a liquid side-draw withdrawal from a high pressure column of a single column air separation unit. With reference to FIG. 3, a feed air stream is fed to main air compressor (MAC) 12 via line 10. After compression the feed air stream is after-cooled usually with either an air cooler or a water cooler, and then processed in unit 16 to remove any contaminants which would freeze at cryogenic temperatures, i.e., water and carbon dioxide. The processing to remove the water and carbon dioxide can be any known process such as an adsorption mole sieve bed. This compressed, water and carbon dioxide free, air is then fed to main heat exchanger 20 via line 18, wherein it is cooled to near its dew point. The cooled feed air stream is then fed to the bottom of rectifier 22 via line 21 for separation of the feed air into a nitrogen overhead stream and a crude liquid oxygen bottoms.

The nitrogen overhead is removed from the top of rectifier 22 via line 24 and is then split into two substreams. The first substream is fed via line 26 to reboiler/condenser 28 wherein it is liquefied and then returned to the top of rectifier 22 via line 30 to provide reflux for the rectifier. The second substream is removed from rectifier 22 via line 32, warmed in main heat exchanger 20 to provide refrigeration and removed from the process as a gaseous nitrogen product stream via line 34.

An oxygen-containing liquid side-draw stream is removed, via line 100, from an intermediate location of rectifier 22. The intermediate location is chosen such that the oxygen-containing side-draw stream, which is a portion of the liquid descending rectifier 22, has an oxygen concentration less than 35% and is essentially free of heavier components such as hydrocarbons, carbon dioxide, krypton and xenon. The oxygen-containing side-draw stream is then reduced is pressure across a valve and fed to fractionator 102 to be stripped thereby producing a stripper overhead and an ultra-high purity oxygen bottoms liquid. The stripper overhead is removed, via line 104, as a waste stream and warmed in heat exchanger 20 to recover refrigeration.

In addition to the oxygen-containing liquid side-draw stream being removed, via line 100, from an intermediate location of rectifier 22, another portion of the liquid descending rectifier 22 is removed as a bypass stream, via line 300, and reintroduced into rectifier 22 at the same column height as the air feed in line 21. It should be noted that, although not shown, the oxygen-containing liquid side-draw stream, in line 100, and the bypass stream, in line 300, could be removed from rectifier 22 together and then split to serve their respective functions. Similarly, the bypass stream, in line 300, could be added to the crude liquid oxygen bottoms leaving the bottom of rectifier 22, in line 38.

At least a portion of the ultra-high purity oxygen bottoms liquid is vaporized by indirect heat exchange in reboiler 286 thereby providing reboil to stripper 102. Heat duty for reboiling fractionator 102 is provided by subcooling a portion of the crude liquid oxygen bottoms. A portion of the crude liquid oxygen bottoms, in line 38, is fed, via line 288, to reboiler 286, located in the bottom of stripper 102. In reboiler 286, the portion is subcooled thereby providing the heat duty required to reboil stripper 102, subsequently reduced in pressure and recombined, via line 290, with the remaining portion of the crude liquid oxygen bottoms, in line 38.

An ultra-high purity oxygen product is removed from the bottom of stripper 102. The product can be removed as a gaseous product via line 112 and/or a liquid product via line 114.

A crude liquid oxygen stream is removed from the bottom of rectifier 22 via line 38, reduced in pressure and fed to the sump surrounding reboiler/condenser 28 wherein it is vaporized thereby condensing the nitrogen overhead in line 26. The vaporized or waste stream is removed from the overhead of the sump area surrounding reboiler/condenser 28 via line 40.

This vaporized waste stream is then processed to recover refrigeration which is inherent in the stream. In order to balance the refrigeration provided to the process from the refrigeration inherent in the waste stream, stream 40 is split into two portions. The first portion is fed to main heat exchanger 20 via line 44 wherein it is warmed to recover refrigeration. The second portion is combined via line 42 with the warmed first portion in line 44 to form line 46. This recombined stream in line 46 is then split into two parts, again to balance the refrigeration requirements of the process. The first part in line 50 is expanded in expander 52 and then recombined with the second portion in line 48, after it has been let down in pressure across a valve, to form an expanded waste stream in line 54. This expanded waste stream is then fed to and warmed in main heat exchanger 20 to provide refrigeration and is then removed from the process as waste via line 56. To limit the number of streams passing through heat exchanger 20, the stripper waste stream in line 104 can be combined with the expanded waste stream from rectifier 22 in line 54.

Finally, a small purge stream is removed via line 60 from the sump surrounding reboiler/condenser 28 to prevent the build up of hydrocarbons in the liquid in the sump. If needed, a liquid nitrogen product is also recoverable as a fraction of the condensed nitrogen stream.

FIG. 4 shows a flowsheet based on a vapor side-draw stream withdrawal from the high pressure or low pressure column. This vapor stream is extremely lean on heavies yet contains oxygen. A separation is performed on this vapor stream to produce ultra-high purity oxygen. This figure is discussed in further detail, as follows.

In FIG. 4, a vapor side-draw stream withdrawn from low pressure column 200, via line 500. This vapor stream is withdrawn a few trays above the point where the top-most feed containing heavies is fed to low pressure column 200, i.e., it is withdrawn a few trays above the point where crude liquid oxygen bottoms is fed, via line 38, from the bottom of high pressure column 22 to low pressure column 200. If expanded feed air is fed above the crude liquid oxygen bottoms feed, then the vapor feed to column 402 will need to be withdrawn a few trays above the expanded air feed to column 200. This position of withdrawal is chosen so that the heavies-free liquid reflux descending down low pressure column 200 would have sufficient trays to strip heavies contaminated vapor ascending low pressure column 200. The bottom of column 402 is reboiled by a gaseous nitrogen stream, line 108, from the top of the high pressure column. Alternatively, a portion of the feed air stream could be used for this purpose. Also, in this FIG. 4, an argon-rich stream is withdrawn, via line 460, from column 402 and fed to low pressure column 200. This step is optional and is used to reduce the content of argon in the ultra-high purity oxygen.

Finally, a portion of the liquid descending low pressure column 200 is removed, via line 300, and reintroduced into rectifier 200 at the same column height as the crude liquid oxygen bottoms feed in line 38.

FIG. 5 is still another variation which can be specially useful when small quantities of ultra-high purity oxygen are required. Similar to FIG. 4, a vapor side-draw stream containing oxygen but extremely lean on heavies is withdrawn via line 600 from high pressure column 22 and used to provide reboil for column 102. The condensed feed stream, in line 602, is reduced in pressure and fed to the top of column 102. The vapor drawn from the top of column 102 via line 104 is fed to a suitable location in the low pressure column. If liquid ultra-high purity oxygen line 114 is to be produced, then an additional liquid feed stream is needed. This stream, which is heavies-free is withdrawn as a side-draw stream, via line 500, from low pressure column 200 and fed to the top of column 102. In this case, a liquid stream descending low pressure column 200 is removed via line 300 as a bypass from the same location as the heavies-free side-draw liquid, in line 500, and returned to low pressure column 200 at a location where the crude liquid oxygen bottoms is fed via line 38.

Although not shown in FIG. 5, in a manner similar to FIG. 3, a liquid bypass steam could be withdrawn from column 22 from the same location as the stream in line 600 and mixed with the crude liquid oxygen bottoms in line 38.

For the cases where gaseous stream is withdrawn either from the high pressure column or the low pressure column and fed to the auxiliary stripping column for the production of ultra-high purity oxygen (FIGS. 4–5), the concentration of oxygen in this vapor stream will be less than 20%. The most likely concentration of oxygen will be in the range of 3% to 15%. A concentration of oxygen less than 1% will be undesirable due to extremely low production rates of ultra-high purity oxygen.

EXAMPLE

To demonstrate the efficacy of the present invention a comparison was computer simulated to compare the process embodiment illustrated in FIG. 3 of this disclosure and the process embodiment taught in FIG. 2 of U.S. Pat. No. 5,049,173. As can be seen from comparison of the two (2) figures, the only difference is the inclusion of the section bypass stream in line 300 of FIG. 3 of this disclosure. The basis for the comparison is as follow:

Main column 22 contains 77 theoretical stages above the side-draw and 13 theoretical stages below. The operating pressure of the column is 140 psia at the top. The nitrogen product purity is 0.1 vppb oxygen. The side-draw flow is 8.1 moles per 100 moles of column feed. The bypass flow was varied from 2 to 6 moles per 100 moles of column feed.

The bypass stream, in line 300, and the side-draw stream, in line 100, originate from the same location in rectifier 22; therefore, both streams have the same composition.

Auxiliary stripping column 103 contains 80 theoretical stages. The operating pressure is 16.5 psia at the top. The ultra-high purity oxygen purity is 0.1 vppb argon and less than 2 vppb methane (feed air quality is 1.5 vppm).

The simulation results of the comparison is show in Table 1.

TABLE 1

| Description | Simulation Basis | | | |
|---|---|---|---|---|
| Bypass Stream 300 | 5,049,173 | Present Invention | | |
| flowrate: mole/100 moles feed | 0 | 2 | 4 | 6 |
| oxygen conc.: mole % | 18.0 | 20.1 | 21.8 | 23.1 |
| methane conc.: vppt | 39 | 64 | 107 | 182 |
| Nitrogen Steam 24 | | | | |
| flowrate: mole/100 moles feed | 36.5 | 36.3 | 36.2 | 36.1 |
| oxygen conc.: mole % | 0.1 | 0.1 | 0.1 | 0.1 |
| Oxygen Streams 112 and 114 | | | | |
| flowrate:mole/100 moles feed | 0.76 | 0.80 | 0.83 | 0.85 |
| argon conc.: vppb | 0.1 | 0.1 | 0.1 | 0.1 |
| methane conc.: vppb | 0.3 | 0.5 | 0.9 | 1.4 |

The results above show that oxygen product can be increased by approximately ten percent (10%) if the bypass flow is set at seventy five percent (75%) of the side-draw flow. The only disadvantage of operating with a bypass is that nitrogen production suffers slightly. The hydrocarbon content of the ultra-high purity oxygen product has also increased slightly but this can be overcome by adding two (2) to three (3) more theoretical stages to the bottom section of the main column. It is important to note that the additional trays would have virtually no effect on the oxygen content of the side-draw stream, in line 100, because the nitrogen-oxygen distillation is pinched by the LN ratio and is, therefore, already overtrayed.

One should also note in Table 1 that the hydrocarbon content of the ultra-high purity oxygen stream, in line 114, is proportional to the hydrocarbon content of the side-draw stream, in line 100. Thus, adding theoretical stages to the bottom section of rectifier 22 to reduce the hydrocarbon content of the bypass and side-draw streams will reduce the hydrocarbon content in the ultra-high purity oxygen.

The claim that hydrocarbon content of the bypass and side-draw streams is easily reduced by adding theoretical stages to the bottom distillation section of the main column is substantiated by the results shown in the simulation set forth in Table 2.

TABLE 2

| Description | Simulation Basis | | | |
|---|---|---|---|---|
| Bypass Stream 300 | 5,049,173 | Present Invention | | |
| flowrate: mole/100 moles feed | 0 | 2 | 4 | 6 |
| methane conc.: vppt | | | | |
| 13 stages in bottom section | 39 | 64 | 107 | 182 |
| 16 stages in bottom section | 3.2 | 6.1 | 11.6 | 22.2 |
| 19 stages in bottom section | 0.3 | 0.6 | 1.3 | 2.7 |

Since methane is the lightest hydrocarbon and since methane is easily reduced by adding stages, then all other hydrocarbons are eliminated also.

Another and equally important advantage of the present invention over the closest prior art (U.S. Pat. No. 5,049,173) is that the bypass allows one to control the composition of the side-draw. During a plant feed upset, the composition of the side-draw stream can change substantially. However, as shown in Table 1, one can also significantly affect the oxygen concentration in the side-draw stream by varying the bypass flow (even at constant side-draw flow). Therefore, one can mitigate the effect of a plant upset by changing the bypass flow, and, thereby maintain a constant oxygen concentration for the side-draw stream and leave the feed to the auxiliary stripping column undisturbed. This control is particularly important because the ultra-high purity oxygen flow is so small compared to the feed flowrate to the column that a small upset in feed composition would result in a relatively large change in the ultra-high purity oxygen product composition.

The technique of bypassing liquid flow around the subject section can be used to an advantage anytime a heavies-free side-draw is employed.

The present invention has been described with reference to several embodiments thereof. These embodiments should not be viewed as limitations on the present invention, such limitations being ascertained by the following claims.

We claim:

1. A process for the fractionation of air by cryogenic distillation using a cryogenic distillation column system comprising at least one distillation column, wherein a feed air stream is compressed, cooled to near its dew point and fed to the distillation column system for rectification thereby producing a nitrogen-containing overhead and a crude liquid oxygen bottoms; wherein an oxygen-containing side-draw stream essentially free of heavier contaminants comprising hydrocarbons, carbon dioxide, xenon and krypton, is removed from the distillation column and stripped in an auxiliary stripping column to produce an ultra-high purity oxygen product at the bottom of the auxiliary stripping column; and wherein the oxygen-containing side-draw stream is removed from a location of the distillation column system primarily separating oxygen and nitrogen and has an oxygen concentration between 1% to 35% oxygen, characterized in that a portion of liquid descending the distillation column system is removed from the distillation section of the distillation column system proximate to the location for withdrawing the oxygen-containing side-draw stream for the auxiliary stripping column thereby reducing the liquid to vapor ratio in the distillation section between where the oxygen-containing side-draw stream is withdrawn and where top-most heavies-containing feed is introduced.

2. A process according to claim 1, wherein the removed liquid portion is introduced to the distillation column system at a location proximate to where the top-most heavies-containing feed is introduced.

3. A process according to claim 1, wherein the removed oxygen-containing side-draw stream to be stripped is removed as a liquid stream.

4. A process according to claim 1, wherein the removed oxygen-containing side-draw stream to be stripped is removed as a vapor stream.

5. A process according to claim 1, wherein heat duty to provide reboil to the auxiliary stripping column is provided by subcooling at least a portion of the crude liquid oxygen bottoms from the distillation column of the cryogenic distillation column system.

6. A process according to claim 1, wherein heat duty to provide reboil to the auxiliary stripping column is provided by at least partially condensing a portion of the nitrogen overhead from the distillation column of the cryogenic distillation column system.

7. A process according to claim 1, wherein the cryogenic distillation column system comprises a high pressure distillation column and a low pressure distillation column, wherein the feed air stream is compressed, cooled to near its dew point and fed to the high distillation column system for rectification thereby producing a nitrogen-containing overhead and a crude liquid oxygen bottoms and wherein the crude liquid oxygen is reduced in pressure, fed to and further fractionated in the low pressure distillation column thereby producing a low pressure nitrogen overhead.

8. A process according to claim 7, wherein the removed oxygen-containing side-draw stream to be stripped is removed as a liquid stream.

9. A process according to claim 7, wherein the removed oxygen-containing side-draw stream to be stripped is removed as a vapor stream.

10. A process according to claim 7, wherein the removed oxygen-containing side-draw stream to be stripped is removed from the low pressure column.

11. A process according to claim 7, wherein the removed oxygen-containing side-draw stream to be stripped is removed from the high pressure column.

12. A process according to claim 1 wherein the cryogenic distillation column system consists of a single (nitrogen generator) distillation column and wherein said auxiliary stripping column is refluxed with a liquid stream from the distillation column which is essentially free of heavier components comprising hydrocarbons, carbon dioxide, xenon and krypton.

13. A process according to claim 12, wherein the removed oxygen-containing side-draw stream to be stripped is removed as a liquid stream.

14. A process according to claim 12, wherein the removed oxygen-containing side-draw stream to be stripped is removed as a vapor stream.

15. A process according to claim 12, wherein heat duty to provide reboil to the auxiliary stripping column is provided by condensing at least a portion of the oxygen-containing side-draw stream prior to rectification.

* * * * *